US005596968A

United States Patent [19]

Ueda et al.

[11] Patent Number: 5,596,968

[45] Date of Patent: Jan. 28, 1997

[54] FUEL INJECTION CONTROL SYSTEM AND METHOD FOR INTERNAL COMBUSTION ENGINE

[75] Inventors: Katsunori Ueda, Kyoto; Satoshi Yoshikawa, Otsu; Takashi Kawabe, Kyoto, all of Japan

[73] Assignee: Mitsubishi Jidosha Kogyo Kabushiki Kaisha, Tokyo, Japan

[21] Appl. No.: 355,262

[22] Filed: Dec. 8, 1994

[30] Foreign Application Priority Data

Dec. 9, 1993 [JP] Japan ..... 5-309476

[51] Int. Cl.[6] ..... F02D 41/32

[52] U.S. Cl. ..... 123/480; 123/492

[58] Field of Search ..... 123/480, 492, 123/493, 478

[56] References Cited

U.S. PATENT DOCUMENTS 5,080,071 1/1992 Minamitani et al. ..... 123/478

5,086,744 2/1992 Ishihara et al. ..... 123/480

5,134,983 8/1992 Kusunoki et al. ..... 123/492

FOREIGN PATENT DOCUMENTS 4-36032 2/1992 Japan .

*Primary Examiner*—Andrew M. Dolinar

[57] ABSTRACT

Described are a fuel injection control system and method, which are suitable for use in an engine of the system that fuel is injected in an intake pipe. It is the object of these system and method to perform good control on the injection quantity of fuel by precisely grasping evaporation characteristics of the fuel. To achieve this object, a direct feed rate at which a quantity of fuel out of a basic injection quantity is directly fed to a combustion chamber is set and further, an indirect feed quantity of fuel, said fuel being to evaporate from an adhered liquid layer of fuel in an intake port and then to be fed into the combustion chamber, is calculated as the sum of plural partial feed quantities of different evaporation characteristics.

31 Claims, 11 Drawing Sheets

FUEL INJECTION CONTROL SYSTEM AND METHOD FOR INTERNAL COMBUSTION ENGINE

BACKGROUND OF THE INVENTION a) Field of the Invention

This invention relates to a fuel injection control system and method suitable for use in an internal combustion engine of the system that fuel is injected into an intake pipe.

b) Description of the Related Art

Intake pipe fuel injection control systems have found wide-spread commercial utility in recent years, because they can more readily perform high-accuracy control on the quantity of fuel to be fed, maintain an adequate air/fuel ratio and also meet the move toward internal combustion engines (which may hereinafter be called merely the "engines") of higher power output.

An internal combustion engine equipped with such a fuel injection control system enjoys such merits as described above but, on the other hand, involves the problem of transitional fluctuations in air/fuel ratio due to the existence of adhered fuel in an intake pipe.

Described specifically, fuel is not injected directly into a cylinder but is injected into the injection pipe, so that a portion of the fuel so injected adheres an inner wall of the intake pipe and an evaporated portion of the adhered fuel is then fed into the cylinder. Even if fuel is injected in a quantity corresponding to the quantity of inducted air, fuel may be fed too little or too much into the cylinder in a transition period upon acceleration, deceleration or the like, leading to a potential problem of inducing a misfire, fluctuations in air/fuel ratio, a deterioration to exhaust gas, or the like.

To cope with such a potential problem, techniques have been provided for performing control upon acceleration or deceleration by calculating the quantity of adhered fuel and correcting the quantity of fuel to be injected.

According to the technique disclosed, for example, in Japanese Patent Application Laid-Open (Kokai) No. HEI 4-36032, a fuel injection quantity Gf is controlled by calculating it in accordance with the following formula:

$$Gf=\{[Qp/(A/F)]-\beta\beta\cdot Mf(n)\}/(1-XX) \quad (1)$$

$$Mf(n)=(1-\beta\beta)\cdot Mf(n)+XX\cdot Gf \quad (2)$$

where

Qp: the quantity of inducted air,

A/F: the target air/fuel ratio,

Mf(n): the quantity of fuel remaining one cycle before in an intake port in an n-cylinder engine, ββ: the rate of evaporation of fuel in the intake port between an intake stroke and the next intake stroke in a cylinder, and XX the rate of adhesion of injected fuel on an inner wall of the intake port.

Further, means for performing the above calculation is constructed based on the concept that the quantity of evaporation of adhered fuel is a first-order delay response and the sum of the quantity of evaporation of the adhered fuel and the quantity of fuel directly fed without adhesion is the feed quantity of fuel.

Control by such conventional calculation means is however accompanied by problems to be described next.

Adhered fuel includes not only fuel adhered on an inner wall of an intake pipe but also that adhered on an intake valve. The intake valve becomes as hot as about 200° C. during operation so that the temperature of the intake valve is higher than the temperature of the inner wall of the intake pipe, the latter temperature being about 80° C. or so. Accordingly the fuel adhered on the intake valve is prone to evaporation and has a higher velocity of evaporation.

Further, the inner wall of the intake pipe and the intake valve are different from each other in the characteristics of a temperature increase responsive to the state of operation of the engine.

The rate of evaporation of fuel cannot be expressed by a single characteristic value like ββ in the formula described above. This also indicates that a fuel feeding system is not characterized by such a simple first-order delay characteristic as has been recognized generally. The rate of evaporation of fuel exhibits substantial influence especially in a transition state of operation. To perform good control even during such a transition state, it is necessary to effect a correction with the above-described evaporation characteristics in view.

Of the injected fuel, the fuel to be fed directly into the cylinder includes that to be fed as a result of prompt evaporation subsequent to its adhesion on the inner wall of the intake pipe and the intake valve. When the velocity of evaporation drops in a cold state, the rate of fuel to be fed directly becomes smaller so that conventional control means cannot perform appropriate control on the quantity of fuel to be injected. Hence a correction is also needed in this respect.

SUMMARY OF THE INVENTION

This invention has been created in view of such problems as described above and as an object thereof, has the provision of a fuel injection control system and method for an engine so that evaporation characteristics of fuel is appropriately grasped to permit good control on the quantity of fuel to be injected.

In one aspect of the present invention, there is thus provided a fuel injection control system for an engine, said system being provided with:

means for setting a basic injection quantity of fuel in correspondence to the quantity of air to be inducted and fed to said engine so that a desired air/fuel ratio can be achieved in a combustion chamber, means for correcting the basic injection quantity, and means for injecting an actual injection quantity of fuel into an intake port of said engine, said actual injection quantity having been obtained by correcting the basic injection quantity by said injection quantity correction means, characterized in that:

said injection quantity correction means comprises:

means for setting a direct feed rate at which a quantity of fuel out of the basic injection quantity is directly fed to said combustion chamber; and means for calculating an indirect feed quantity of fuel, said fuel being to evaporate from an adhered liquid layer of fuel in said intake port and then to be fed into said combustion chamber, as the sum of plural partial feed quantities of different evaporation characteristics.

The injection quantity correction means can comprise:

means for calculating a direct feed quantity of fuel, said fuel being to be directly fed to said combustion chamber, by using the basic injection quantity and the direct feed rate;

means for calculating a predicted feed quantity of fuel, which is predicted to be achieved by injecting the basic injection quantity of fuel, by using the indirect feed quantity and the basic feed quantity;

means for calculating a correction quantity, which is needed to achieve feeding of fuel in the basic injection quantity, by calculating the difference between the basic injection quantity and the predicted feed quantity and then compensating the difference together with the direct feed rate; and means for calculating the actual injection quantity, in which fuel should be injected from said fuel injection means into said intake port, by using the basic injection quantity and the correction quantity.

Here, the direct feed rate may preferably be set as a function of the temperature and speed of said engine.

Preferably, said indirect feed quantity calculation means may determine the indirect feed quantity repeatedly, and may calculate a present indirect feed quantity by using an actual injection quantity in which fuel has been injected immediately before the present injection, the direct feed rate, and an indirect feed quantity for the injection immediately before the present injection, said indirect feed quantity having been used for the calculation of the actual injection quantity in which fuel has been injected immediately before the present injection.

At this time, said indirect feed quantity calculation means may preferably calculate the indirect feed quantity by using means for calculating a first-part feed quantity occurring as a result of evaporation of fuel adhered on an intake valve and means for calculating a second-part feed quantity occurring as a result of evaporation of fuel adhered on a wall of said intake port.

Further, a distribution coefficient at which the fuel injected into said intake port adheres on said intake valve and said wall of said intake port may preferably be set based on areas of adhesion of said intake valve and said wall of said intake port, respectively; and in said indirect feed quantity calculation means, said first-part feed quantity calculation means may preferably calculate a present first-part feed quantity, which occurs as a result of evaporation of fuel adhered on said intake valve, by using an actual injection quantity in which fuel has been injected immediately before the present injection, the direct feed rate, the first-part feed quantity used for the calculation of the actual injection quantity in which fuel has been injected immediately before the present injection, and the distribution coefficient, and said second-part feed quantity calculation means may calculate a present second-part feed quantity, which occurs as a result of evaporation of fuel adhered on said wall of said intake port, by using the actual injection quantity in which fuel has been injected immediately before the present injection, the direct feed rate, the second-part feed quantity used for the calculation of the actual injection quantity in which fuel has been injected immediately before the present injection, and the distribution coefficient.

In addition, said distribution coefficient may preferably be set as a function of the ratio of the area of adhesion of said intake valve to that of said wall of said intake port and the temperature of said engine.

Further, said first-part feed quantity calculation means may preferably calculate the first-part feed quantity by using a first smoothing factor and said second-part feed quantity calculation means may calculate the second-part feed quantity by using a second smoothing factor.

Here, it is preferred that said first smoothing factor and said second smoothing factor are each set as a function of the temperature of said engine and also that the value of said first smoothing factor (X) is set as a value greater than the value of the second smoothing factor (Y).

Further, said predicted feed quantity calculation means may preferably calculate the predicted feed quantity in accordance with the following formula:

$$TTRNS(n)=TB(n)\cdot\alpha+TTRNSX(n')+TTRNSY(n')$$

where

TTRNS (n): the predicted feed quantity,

TB(n): the basic injection quantity,

TTRNSX(n'): the first-part feed quantity in the same cylinder immediately before the present injection, TTRNSY(n'): the second-part feed quantity in the same cylinder immediately before the present injection, and α: the direct feed rate.

On the other hand, said indirect feed quantity calculation means may preferably calculate the present first-part feed quantity and the present second-part feed quantity in accordance with the following formulas, respectively:

$$TTRNSX(n)=(1-X)\cdot TTRNSX(n')+X\cdot(1-\alpha)\cdot\beta\cdot TINJ(n)$$

$$TTRNSY(n)=(1-Y)\cdot TTRNSY(n')+Y\cdot(1-\alpha)\cdot(1-\beta)\cdot TINJ(n)$$

where

TTRNSX(n): the present first-part feed quantity,

TTRNSY(n): the present second-part feed quantity,

TINJ(n): the actual injection quantity in which fuel has been injected immediately before the present injection, TTRNSX(n'): the first-part feed quantity in the same cylinder immediately before the present injection, TTRNSY(n'): the second-part feed quantity in the same cylinder immediately before the present injection, X: the first smoothing factor, Y: the second smoothing factor, α: the direct feed rate, and β: the distribution coefficient.

In another aspect of the present invention, there is also provided a fuel injection control method for injecting, into an intake port of an engine, fuel in an actual injection quantity obtained by correcting a basic injection quantity of fuel set in correspondence to the quantity of air to be inducted and fed to said engine so that a desired air/fuel ratio can be achieved in a combustion chamber, characterized in that upon correction of the basic injection quantity, said method comprises the following steps:

(a) setting a direct feed rate at which a quantity of fuel out of the basic injection quantity is directly fed to said combustion chamber;

(b) calculating an indirect feed quantity of fuel, said fuel being to evaporate from an adhered liquid layer of fuel in said intake port and then to be fed into said combustion chamber, as the sum of plural partial feed quantities of different evaporation characteristics;

(c) calculating a direct feed quantity of fuel, said fuel being to be directly fed to said combustion chamber, by using the basic injection quantity and the direct feed rate;

(d) calculating a predicted feed quantity of fuel, which is predicted to be achieved by injecting the basic injection quantity of fuel, by using the indirect feed quantity and the basic feed quantity;

(e) calculating a correction quantity, which is needed to achieve feeding of fuel in the basic injection quantity, by calculating the difference between the basic injection quantity and the predicted feed quantity and then compensating the difference together with the direct feed rate; and (f) calculating.the actual injection quantity from the basic injection quantity and the correction quantity.

Preferably, said indirect feed quantity calculation step (b) may comprise the following sub-steps:

(b-1) determining the indirect feed quantity repeatedly; and (b-2) calculating a present indirect feed quantity by using an actual injection quantity in which fuel has been injected immediately before the present injection, the direct feed rate, and an indirect feed quantity for the injection immediately before the present injection, said indirect feed quantity having been used for the calculation of the actual injection quantity in which fuel has been injected immediately before the present injection.

Further, said indirect feed quantity calculation step (b) may preferably comprise the following sub-steps:

(b-1) calculating a first-part feed quantity occurring as a result of evaporation of fuel adhered on an intake valve; and (b-2) calculating a second-part feed quantity occurring as a result of evaporation of fuel adhered on a wall of said intake port.

Preferably, said indirect feed quantity calculation step (b) may comprise the following sub-steps:

(b-1) setting a distribution coefficient, at which the fuel injected into said intake port adheres on said intake valve and said wall of said intake port, respectively, based on areas of adhesion of said intake valve and said wall of said intake port, respectively, and setting a first smoothing coefficient and second smoothing coefficient which correspond to rates of evaporation of the adhered fuel from said intake valve and said wall of said intake port, respectively; and (b-2) calculating a present first-part feed quantity, which occurs as a result of evaporation of the fuel adhered on said intake valve, by using an actual injection quantity in which fuel has been injected immediately before the present injection, the direct feed rate, the first-part feed quantity used for the calculation of the actual injection quantity in which fuel has been injected immediately before the present injection, the distribution coefficient, and the first smoothing coefficient, and calculating a present second-part feed quantity, which occurs as a result of evaporation of the fuel adhered on said wall of said intake port, by using the actual injection quantity in which fuel has been injected immediately before the present injection, the direct feed rate, the second-part feed quantity used for the calculation of the actual injection quantity in which fuel has been injected immediately before the present injection, the distribution coefficient, and the second smoothing coefficient.

At this time, said distribution coefficient may preferably be set as a function of the ratio of the area of adhesion of said intake valve to that of said wall of said intake port and the temperature of said engine.

It is preferred that said first smoothing factor and said second smoothing factor are each set as a function of the temperature of said engine and also that the value (X) of said first smoothing factor is set as a value greater than the value (Y) of the second smoothing factor.

Where the engine is equipped with plural cylinders, each of the quantities described above means the quantity for the same cylinder out of the plural cylinders.

According to the present invention, the following effects or advantages are obtained.

(1) The temperature distribution which varies corresponding to the operation temperature of the engine, like the temperatures of the valve and the inner wall of the intake pipe, as well as the characteristics of evaporation and feeding of fuel from the inside of the intake port, said characteristics varying in response to variations in the temperature distribution, are precisely reflected in terms of a predetermined distribution ratio upon calculation of a fuel injection quantity, so that a correct fuel injection quantity commensurate with the state of operation can be calculated.

(2) Owing to the above effect, calculation of a precise fuel injection quantity is performed even during a transition period such as an acceleration or deceleration at the time of a cold state (i.e., a low coolant temperature). This always makes it possible to perform precise control on the air/fuel ratio and hence to achieve a stable operation state of the engine.

DETAILED DESCRIPTION OF THE INVENTION AND PREFERRED EMBODIMENT

A description will hereinafter be made of the one embodiment of the present invention with reference to the drawings.

Figure 3:
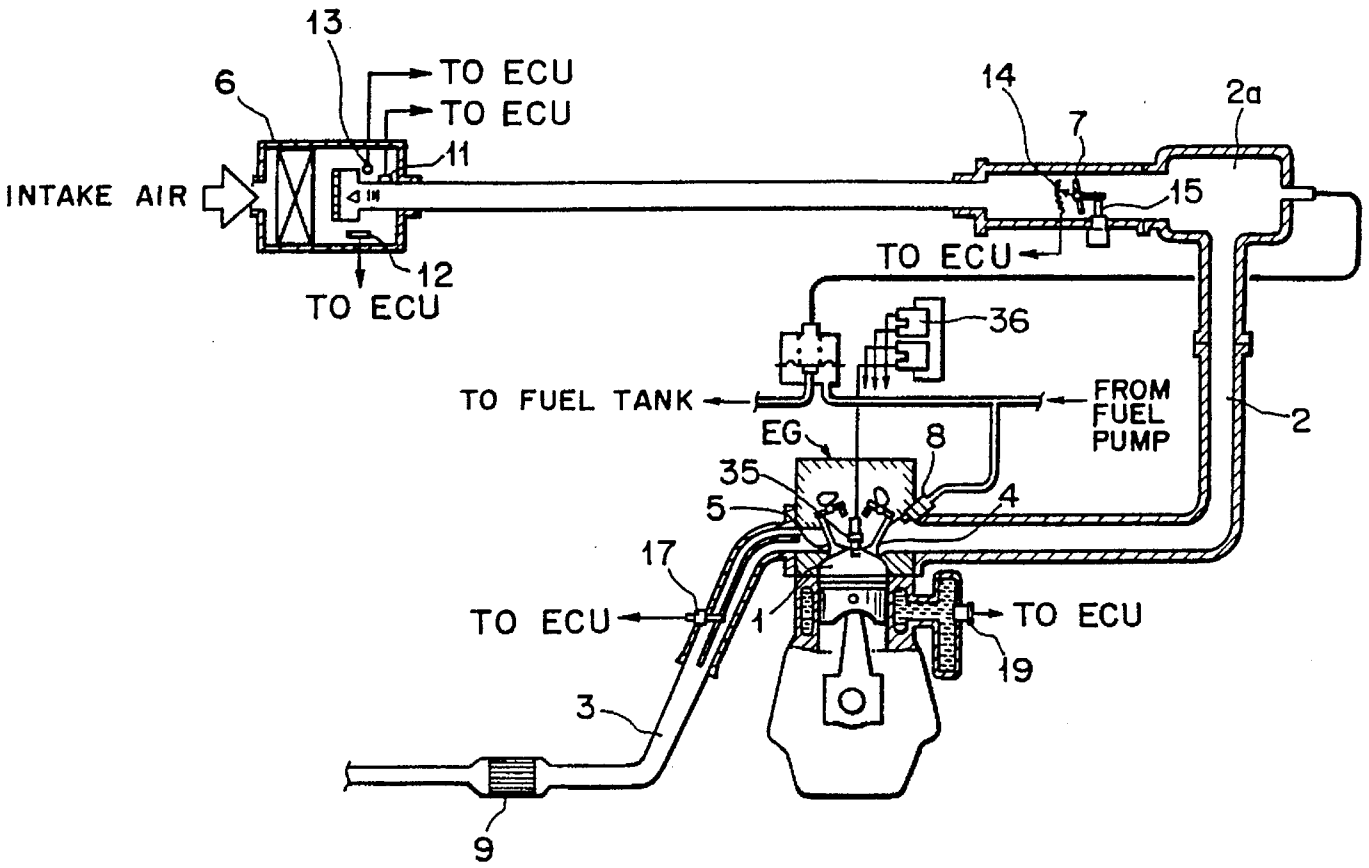
FIG. 3 is an overall construction diagram of an engine system equipped with the control system according to the one embodiment of the present invention for the engine.

The engine system equipped with the fuel injection control system is illustrated as shown in FIG. 3. In FIG. 3, an engine (internal combustion engine) EG has an intake passage 2 and exhaust passage 3 extending to a combustion chamber 1. The intake passage 2 and the combustion chamber 1 are communicated with each other under control by an intake valve 4, whereas the exhaust passage 3 and the intake chamber 1 are communicated with each other under control by an exhaust valve 5.

The intake passage 2 is provided with an air cleaner 6, a throttle valve 7 and an electromagnetic fuel injection valve (injector) 8, which are arranged one after another from an upstream side. The exhaust passage 3, on the other hand, is provided with an exhaust-gas cleaning catalytic converter (3-way catalyst) 9 and an unillustrated muffler (noise deadening device), which are disposed one after the other from an upstream side. A surge tank **2*a* is also arranged in the intake passage 2**.

Injectors 8 as many as the number of cylinders are arranged in an intake manifold section. Now assuming that the engine EG is an in-series 4-cylinder engine, four injectors 8 are arranged. The engine EG can therefore be considered as a so-called multicylinder engine of the multipoint fuel injection (MPI) system.

Further, the throttle valve 7 is connected to an accelerator pedal via a wire cable, whereby the opening of the throttle valve varies depending on the stroke of the accelerator pedal. The throttle valve 7 is also designed to be driven, that is, to be opened or closed by an idling speed control motor (ISC motor), so that the opening of the throttle valve 7 can be changed even if the accelerator pedal is not depressed during idling.

Owing to the construction described above, air inducted through the air cleaner 6 in accordance with the opening of the throttle valve 7 is mixed with fuel from the injector 8 within the intake manifold so that an appropriate air/fuel ratio is achieved. By causing a spark plug 35 to form a spark at a desired timing in the combustion chamber 1 through an ignition coil 36, the fuel is caused to burn to produce an engine torque. The resulting gaseous mixture is exhausted as exhaust gas into the exhaust passage 3. Subsequent to purification of three noxious components, CO, HC and NOx, in the exhaust gas through the catalytic converter 9, the exhaust gas is deadened in noise and then released into the atmosphere.

A variety of sensors are also arranged to control the engine EG. First, on a side of the intake passage 2, an air flow sensor (inducted air sensor) 11 for detecting the volume of inducted air (volumetric flow rate) from Karman vortex information, an intake air temperature sensor 12 for detecting the temperature of inducted air and an atmospheric sensor 13 for detecting the atmospheric pressure are arranged in a section where an air cleaner is disposed and, further, a throttle position sensor 14 of the potentiometer type for detecting the opening of the throttle valve 7, an idling switch 15 for detecting an idling state, and the like are arranged in a section where the throttle valve is disposed.

On a side of the exhaust passage 3, on the other hand, an oxygen concentration sensor 17 (hereinafter simply called the "$O_2$ sensor 17") for detecting the concentration of oxygen (the $O_2$ concentration) in exhaust gas is arranged on an upstream side of the catalytic converter 9.

Figure 2:
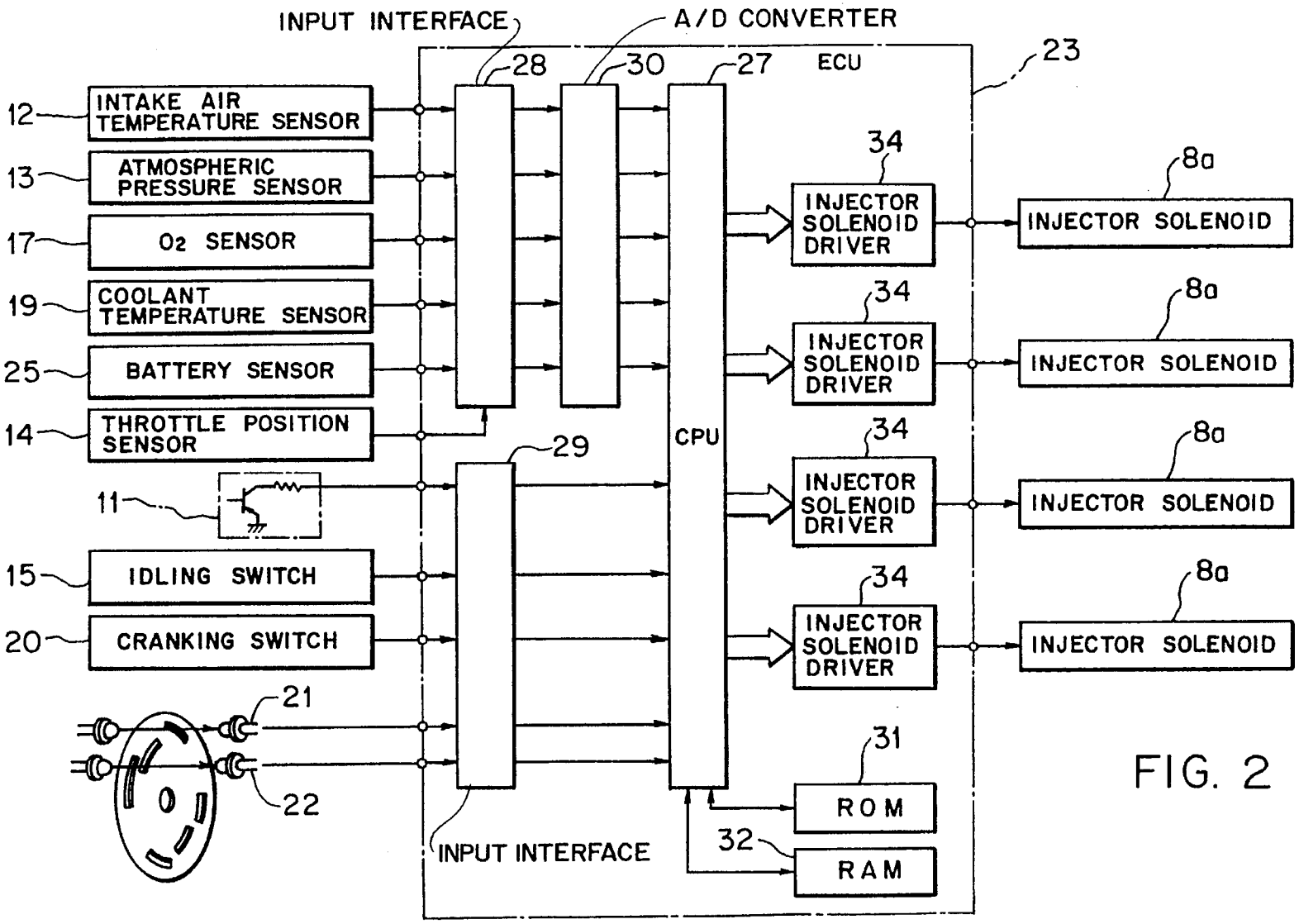
FIG. 2 is a hardware block diagram of the control system according to the one embodiment of the present invention for the engine.

Arranged as other sensors in a distributor include a coolant temperature sensor 19 for detecting the temperature of an engine coolant and as shown in FIG. 2, a crank angle sensor 21 for detecting a crank angle (which also serves as an engine speed sensor for detecting the revolution speed of the engine) and a TDC sensor (cylinder sensor) 22 for detecting the top dead center of the first cylinder (base cylinder).

Detection signals from these sensors are inputted to an electronic control unit (ECU) 23.

Also inputted to ECU 23 are a voltage signal from a battery sensor 25 for detecting the voltage of a battery and a signal from a cranking switch 20 or an ignition switch (key switch) for detecting a startup.

Incidentally, the hardware construction of ECU 23 can be illustrated as shown in FIG. 2. ECU 23 is provided with CPU 27 as a principal component thereof. To CPU 27, detection signals from the intake air temperature sensor 12, the atmospheric pressure sensor 13, the throttle position sensor 14, the $O_2$ sensor 17, the coolant temperature sensor 19 and the battery sensor 25 are inputted via an input interface 28 and an A/D converter 30 and further, detection signals from the air flow sensor 11, the crank angle sensor 21, the TDC sensor 22, the idling switch 15, the cranking switch 20, the ignition switch and the like are inputted via an input interface 29.

Through a bus, CPU 27 exchanges data with ROM 31 with program data and fixed value data stored therein, RAM 32 whose data can be updated and changed at any time, and RAM (not illustrated) backed up by the battery while connected to the battery so that its stored contents are retained.

Incidentally, the data of RAM 32 are cleared and reset when the ignition switch is turned off.

Further, fuel injection control signals produced based on the results of computation by CPU 27 are outputted to solenoids (injector solenoids) 8*a* (precisely, transistors for the injector solenoids 8*a*) of the respective injectors 8 via four injector solenoid drivers 34.

Figure 1:
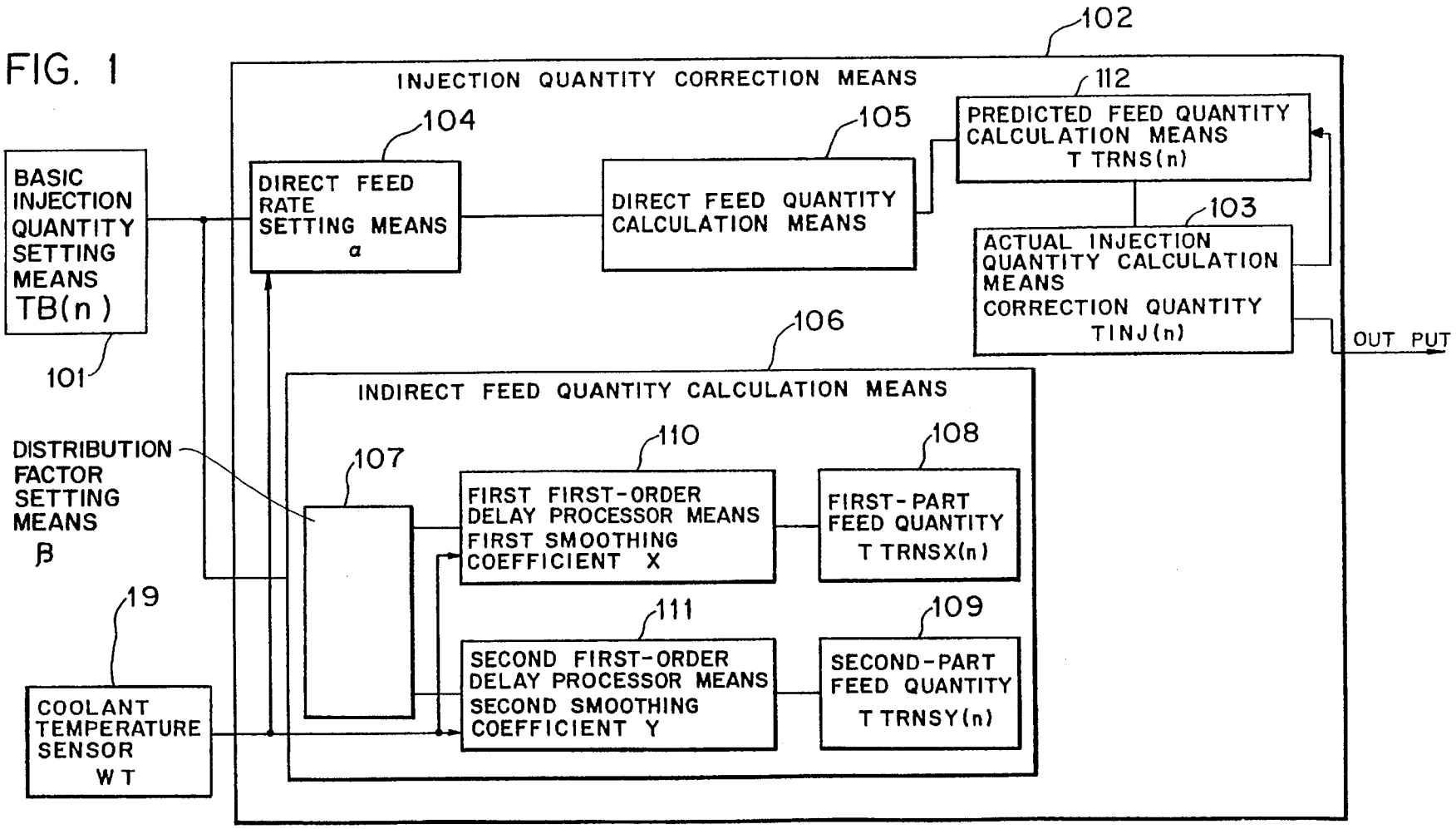
FIG. 1 is a block diagram showing a control system of a fuel injection control system according to one embodiment of the present invention for an engine.

A description is now made of fuel injection control (air/fuel ratio control). Fuel injection control signals computed in a manner to be described subsequently are outputted from CPU 27 to the respective injector solenoids 8*a* through the associated drivers 34, whereby the four injectors 8 are successively driven. For such fuel injection control (injector drive time control), ECU 23 is provided, as shown in FIG. 1, with functions of basic injection quantity setting means 101 and injection quantity correcting means 102.

Here, the basic injection quantity setting means 101 is constructed so that a basic injection quantity TB (n) of fuel for achieving a desired air/fuel ratio A/F relative to the quantity Q(n) of air inducted to the engine is set in accordance with the following formula:

$$TB(n)=KINJ\cdot Q(n) \tag{3}$$

where KINJ is a fuel quantity conversion factor for converting an inducted air quantity to a fuel quantity and is given as a constant.

To perform correction of the basic injection quantity TB(n) in correspondence to the temperature of operation of the engine by using an output from the coolant temperature sensor 19 which detects a coolant temperature WT as an engine temperature, the injection quantity correction means 102 is provided with means to be described hereinafter.

Direct feed rate setting means 104 serves to set the rate of fuel to be fed directly (hereinafter called the "direct feed rate α") to the combustion chamber out of the basic injection quantity. As opposed to the intake port wall adhesion rate XX of injected fuel, said rate being given as a constant in the conventional art, the direct feed rate α (=1−XX) which is the rate of injected fuel to be fed directly into the cylinder without adhesion in the intake port is set according to a map indicative of characteristics f1 of FIG. 6 in this embodiment so that the direct feed rate e is given in correspondence to the coolant temperature WT.

Figure 8:
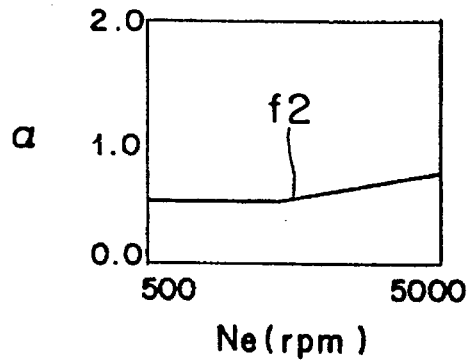

It is also designed that the direct feed rate α can be corrected by values of a map indicative of characteristics f2 of FIG. 8. The direct feed rate α is corrected in such a way that, when the engine speed has increased to a medium speed or so or higher, the direct feed rate is set higher in correspondence to the engine speed.

Here, the direct feed rate α is expressed by the following formula (4):

$$\alpha=f1(WT)\times f2(Ne) \tag{4}$$

The correction by the characteristics f2 is set to cope with the phenomenon that, when the engine speed becomes higher, the injection timing begins to overlap with the intake stroke and more fuel hence enters directly into the cylinder.

Direct feed quantity calculation means 105 is also arranged. Since the direct feed quantity Tα(n) of fuel to be directly fed without adhesion in the intake port amounts to the rate α of the basic injection quantity TB, the direct feed quantity calculation means 105 is constructed to calculate the direct feed quantity in accordance with the following formula (5):

$$T\alpha(n)=TB\cdot\alpha \quad (5)$$

Also provided is indirect feed quantity calculation means 106 for calculating the indirect feed quantity of fuel which evaporates from an adhered fuel film in the intake port and is fed to the combustion chamber.

To calculate the indirect feed quantity as the sum of partial feed quantities corresponding to different evaporation characteristics, the indirect feed quantity calculation means 106 is provided with first first-order delay processor means 110 (a first-part feed quantity calculation means) and second first-order delay processor means 111 (a second-part feed quantity calculation means) for evaporation from the adhered fuel film.

Namely, the first first-order delay processor means 110 is constructed to calculate a first-part feed quantity 108 occurring as a result of evaporation of fuel adhered on the valve, specifically to perform smoothing processing by using a first smoothing coefficient X.

Figure 9:
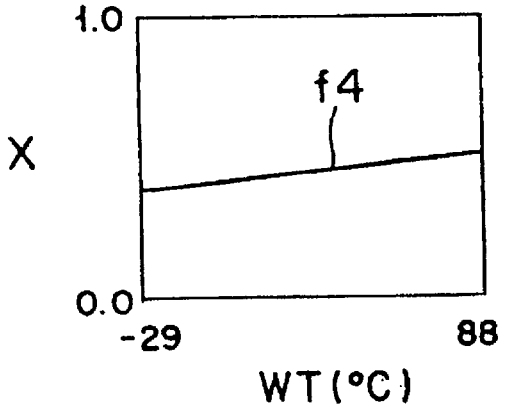

To correspond to temperatures of the valve, characteristics f4 of FIG. 9 are stored in the form of a map. The first smoothing coefficient X is set corresponding to the coolant temperature WT in accordance with the following formula (6):

$$X=f4(WT) \quad (6)$$

Using such a first smoothing coefficient X, the first-part feed quantity 108 is calculated in accordance with a formula (13) which will be described subsequently herein.

The second first-order delay processor means 111, on the other hand, is constructed to calculate a second-part feed quantity 109 occurring as a result of evaporation of fuel adhered on the wall of the pipe, specifically to perform smoothing processing by using a second smoothing coefficient Y.

Figure 10:
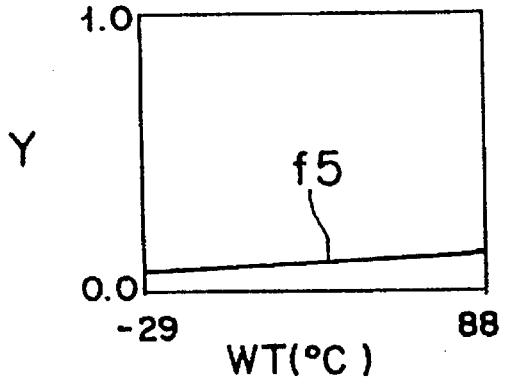

To correspond to temperatures of the pipe wall, characteristics f5 of FIG. 10 are stored in the form of a map. The second smoothing coefficient Y is set corresponding to the coolant temperature WT in accordance with the following formula (7):

$$Y=f5(WT) \quad (7)$$

Using such a second smoothing coefficient Y, the second-part feed quantity 109 is calculated in accordance with a formula (14) which will be described subsequently herein.

As is understood from a comparison between FIG. 9 and FIG. 10, the first smoothing coefficient X and the second smoothing coefficient Y are set in such a way that the second smoothing coefficient Y corresponding to the evaporation of fuel adhered on the pipe wall is set small to be commensurate with a relatively low evaporation velocity of fuel from the pipe wall and the first smoothing coefficient X is set large to be commensurate with a relatively high evaporation velocity of fuel from the valve.

The indirect feed quantity calculation means 106 is provided with distribution factor setting means 107, which with respect to the intake port wall adhesion rate XX, sets a distribution coefficient β as a ratio of the second-part feed quantity "TTRNSY(n)" 109 of the fuel evaporated from the fuel adhered on the pipe wall of the intake port to the first-part feed quantity "TTRNSX(n)" 108 of the fuel evaporated from the fuel adhered on the valve.

Figure 7:
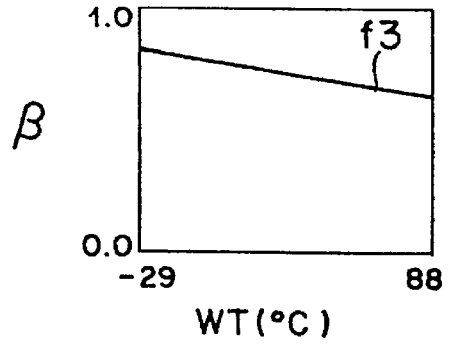

The distribution coefficient β is set as a value close to the ratio of the area of adhesion of the injected fuel on the pipe wall to the area of adhesion of the injected fuel on the valve, said ratio serving as a base value. As the adhesion area ratio varies depending on the coolant temperature WT, characteristics f3 of FIG. 7 are stored in the form of a map and in accordance with the following formula (8), the distribution coefficient β is set as a value corresponding to the coolant temperature WT:

$$\beta=f3(WT) \quad (8)$$

Also arranged is predicted feed quantity calculation means 112 for calculating a predicted feed quantity TTRNS(n), which is expected to be achieved by the injection of the basic injection quantity TB(n), from the indirect feed quantity and the direct feed quantity in accordance with the following formula (9):

$$TTRNS(n)=TB(n)\cdot\alpha+TTRNSX(n-4)+TTRNSY(n-4) \quad (9)$$

In the above formula (9), the first term corresponds to the direct feed quantity whereas the second and third terms are associated with the indirect feed quantity. As the indirect feed quantity, values calculated by the below-described formulas (13) and (14) in the preceding computing cycle are used.

Additionally arranged is actual injection quantity calculation means 103, which is constructed to compensate the difference ΔT(n) between the basic injection quantity TB(n) and the predicted feed quantity TTRNS(n) together the direct feed rate α, so that a correction quantity for the achievement of feeding of the basic injection quantity TB(n) is calculated and the actual injection quantity TINJ(n) including this correction quantity is also calculated.

Namely, the actual injection quantity calculation means 103 is equipped with the function of correction quantity calculation means for calculating the difference ΔT(n) between the basic injection quantity TB(n) and the predicted feed quantity TTRNS(n), compensating the difference ΔT(n) together with the direct feed rate α and hence calculating the correction quantity for the achievement of the feeding of the basic injection quantity TB(n) and also with the function of actual injection quantity calculation means for calculating the actual injection quantity TINJ(n), in which fuel is to be injected from the fuel injection means 8 in the intake port, by using the basic injection quantity TB(n) and the above correction quantity.

Accordingly, the difference ΔT(n) between the basic injection quantity TB(n) and the predicted feed quantity TTRNS(n) can be calculated in accordance with the following formula (10):

$$\Delta T(n)=TB(n)-TTRNS(n) \quad (10)$$

The difference ΔT(n) is then compensated together with the direct feed rate α, and the correction quantity for the achievement of the feeding of the basic injection quantity TB(n) can be calculated in accordance with the following formula (11):

$$(1/\alpha)\cdot\Delta T(n) \quad (11)$$

When the quantity of the difference ΔT(n) is set as the correction quantity, fuel in a quantity corresponding only to the direct feed rate $\alpha$ out of the quantity of the difference $\Delta T(n)$ is fed into the cylinder. In view of the possibility that the correction quantity may become insufficient, the correction quantity is set to give the quantity of the difference $\Delta T(n)$ when multiplied by the direct feed rate $\alpha$.

Further, the actual injection quantity TINJ(n) for the achievement of the feeding of the basic injection quantity TB(n), said actual injection quantity including the correction quantity, is calculated in accordance with the following formula 12):

$$TINJ(n)=TB(n)+(1/\alpha)\cdot\Delta T(n) \quad (12)$$

In addition, the first-part and second-part feed quantities TTRNSX(n),TTRNSY(n) when injection of fuel in the actual injection quantity TINJ(n) has been performed are calculated in accordance with the following formulas (13), (14), respectively:

$$TTRNSX(n)=(1-X)\cdot TTRNSX(n-4)+X\cdot(1-\alpha)\cdot\beta\cdot TINJ(n) \quad (13)$$

$$TTRNSY(n)=(1-Y)\cdot TTRNSY(n-4)+Y\cdot(1-\alpha)\cdot(1-\beta)\cdot TINJ(n) \quad (14)$$

The computation by these formulas (13) (14) is to perform smoothing processing by the smoothing coefficients X,Y with respect to the preceding feed quantities TTRNSX(n−4),TTRNSY(n−4) and the present injection quantity TINJ(n). The first-part and second-part feed quantities TTRNSX(n),TTRNSY(n) resulted from the above computation are used in the computation by the predicted feed quantity calculation means 112 in the next computing cycle.

Incidentally, the actual injection quantity TINJ(n) calculated by the actual fuel injection quantity calculation means 103 is outputted as a fuel injection command so that fuel is injected in a desired quantity via the injection driver 34.

A description will now made of the significance of computation by each of the means described above.

First, it is known from the conventional art that the quantity of fuel to be fed into the cylinder is the sum of the direct feed quantity, in which fuel is to be fed directly without adhesion in the intake port, and the quantity of fuel evaporating from fuel adhered in the intake port and the evaporating quantity is to be fed with a delay due to a first-order delay response [see Japanese Patent Application Laid-Open (Kokai) No. HEI 4-36032].

When control is performed with a view toward coping with this characteristic, the air/fuel ratio is observed to become unstable especially upon transition.

Under the impression that the above evaporating quantity may have two first-order delay elements, a test was conducted by a control ECU to perform computation on a simplified model under the above-described hypothesis, followed by an analysis. Approximate results were obtained as will be described below.

When the direct feed quantity $T\alpha(n)$ of fuel fed directly without adhesion in the intake port accounts for the rate $\alpha$ of the basic injection quantity TB, $$T\alpha(n)=\alpha\cdot TB$$

The quantity of fuel adhered in the intake port without being directly fed is $(1-\alpha)\cdot TB$, and this adhered fuel quantity is the sum of the two first-order delay elements TX and TY.

Expressing the TX:TY distribution ratio by $\beta:(1-\beta)$ and their first-order delay constants by X and Y, respectively, the following formulas can be derived:

$$TX(n)=(1-X)\cdot TX(n-4)+X\cdot(1-\alpha)\cdot\beta\cdot TB \quad (13)$$

$$TY(n)=(1-Y)\cdot TY(n-4)+Y\cdot(1-\alpha)\cdot(1-\beta)\cdot TB \quad (14)$$

The feed quantity is determined as the sum of these first-order delay elements. Here, TX and TY are values which reflect the quantity of fuel not fed into each cylinder in the preceding cycle, so that values in the cycle delayed by 1 cycle relative to $T\alpha$ are used. Since ECU performs computation at a predetermined crank angle of each cylinder, the preceding cycle in a given cylinder is the (n−4)th cycle in the case of a 4-cylinder engine.

The feed quantity TTRNS(n) can therefore be expressed by the following formula (15):

$$TTRNS(n)=T\alpha(n)+TX(n-4)+TY(n-4) \quad (15)$$

Figure 11:
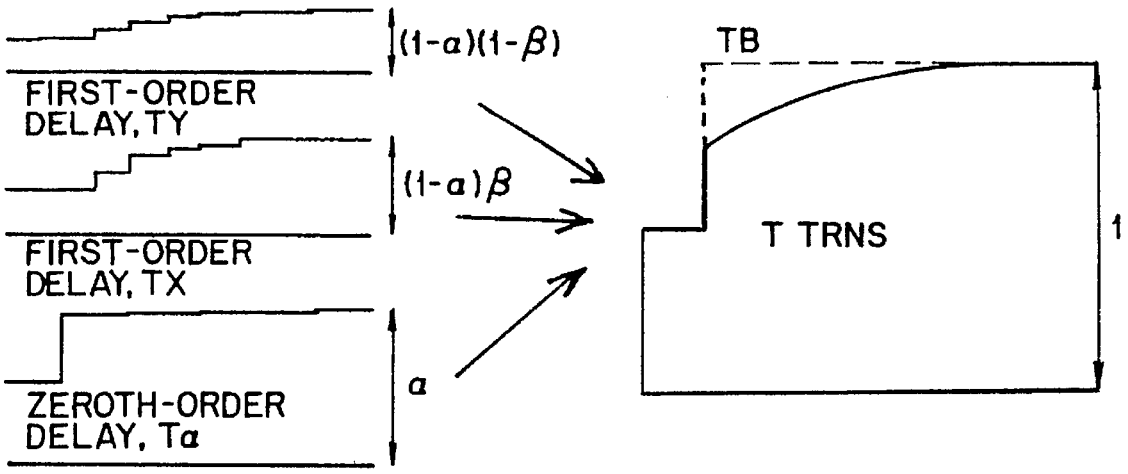
FIGS. 11 through 16 diagrammatically illustrate the concept of calculation of a fuel feed quantity by the control system according to the one embodiment of the present invention for the engine.

As a result of this computation, such characteristics as shown on a right side in FIG. 11 are obtained.

The feed quantity TTRNS(n) upon injection of the basic injection quantity TB, said feed quantity having been obtained as described above, has an under/over feed quantity $\Delta T$ relative to the target feed quantity (basic injection quantity TB).

$$\Delta T(n)=TB(n)-TTRNS(n) \quad (16)$$

Fuel is therefore injected in a quantity including a correction fuel quantity equivalent to $\Delta T$ in addition to the basic injection quantity TB. Taking into consideration that a portion of the correction fuel also adheres in the intake port, the actual fuel injection quantity TINJ(n) is determined by the following formula (17) while using the direct feed rate $\alpha$:

$$TINJ(n)=TB(n)+(1/\alpha)\cdot\Delta T(n) \quad (17)$$

The feed delay is therefore compensated.

Figure 12:
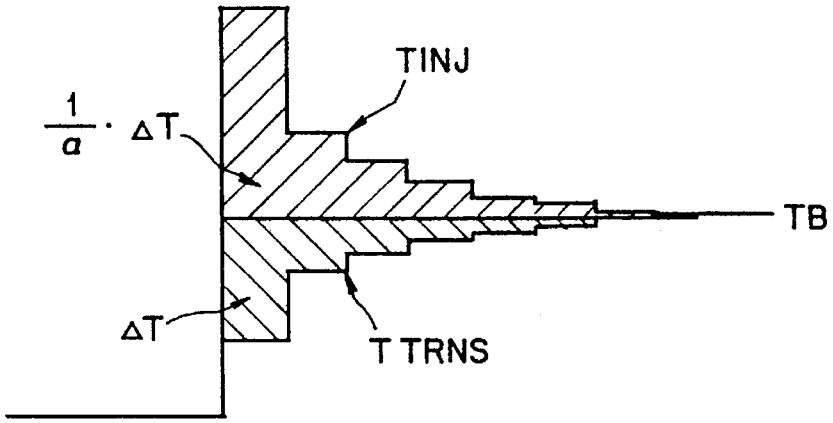

Here, the calculation concept of the actual fuel injection quantity TINJ(n) by the formulas (16) and (17) can be expressed as shown in FIG. 12.

Incidentally, the individual coefficients for the determination of the above-described feed quantity are determined as will be described next.

First, $\alpha$ is a direct feed component and is the rate of the zero-order component. It corresponds to the component $\alpha$ in FIG. 13, and can be determined by a real-engine test in which the fuel injection quantity is changed stepwise.

Taking X and Y as a fast first-order time constant and a slow first-order time constant, respectively, the fast time constant depending on the intake valve temperature and the slow time constant depending on the wall temperature of the intake pipe can be expressed by X and Y, respectively.

Figure 13:
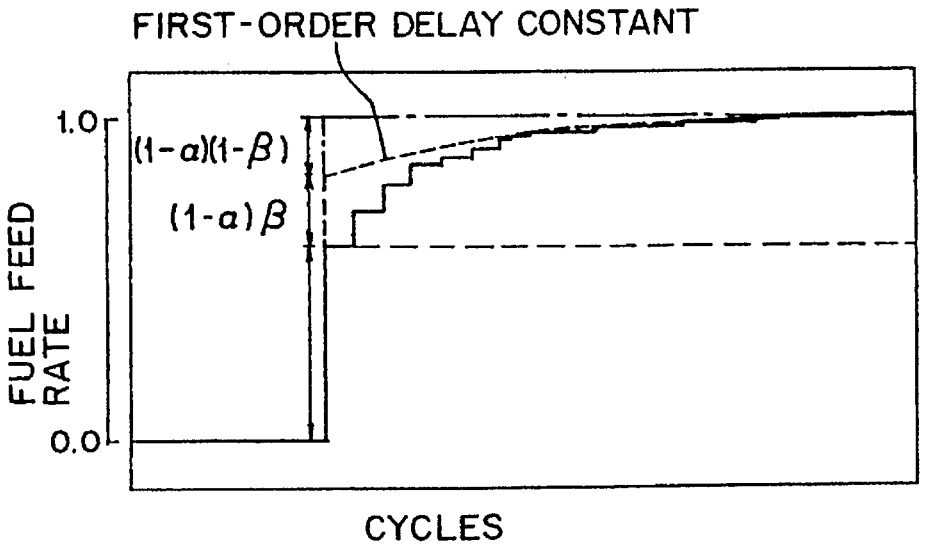

Since the latter half part of the increase in the feed quantity shown in FIG. 13 can be considered to be governed by the slow time constant, $\beta$ and Y can be determined from the characteristics of the diagram.

As is shown in FIG. 13, $\alpha$ can also be determined from the diagram. X is hence determined by introducing $\beta$, Y and $\alpha$, which have been obtained above, into the calculation formula of the feed quantity.

Figure 14:
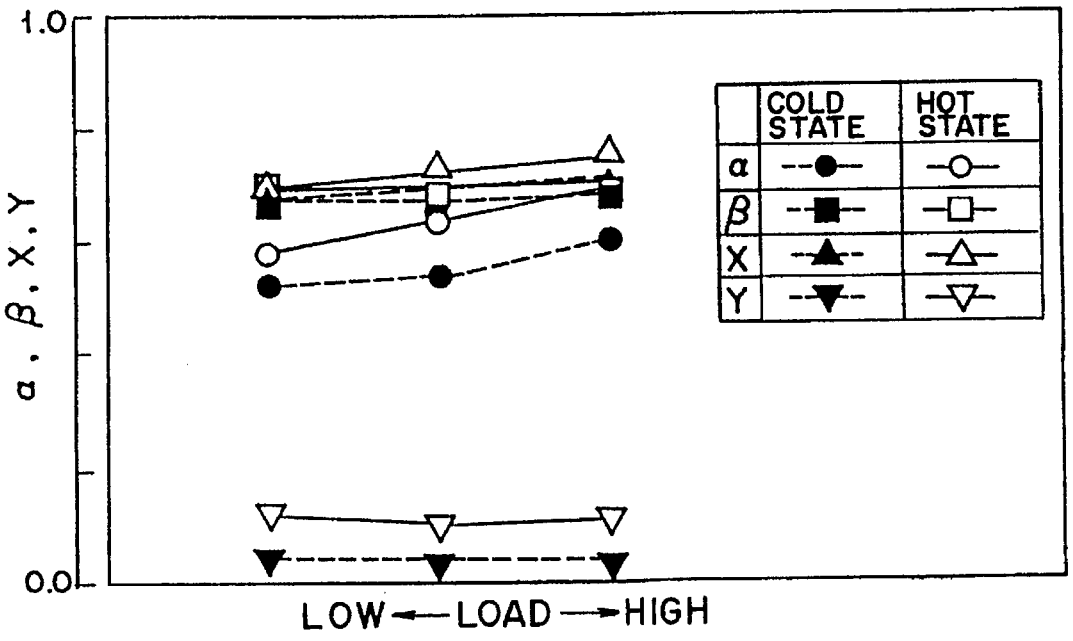
Figure 15:
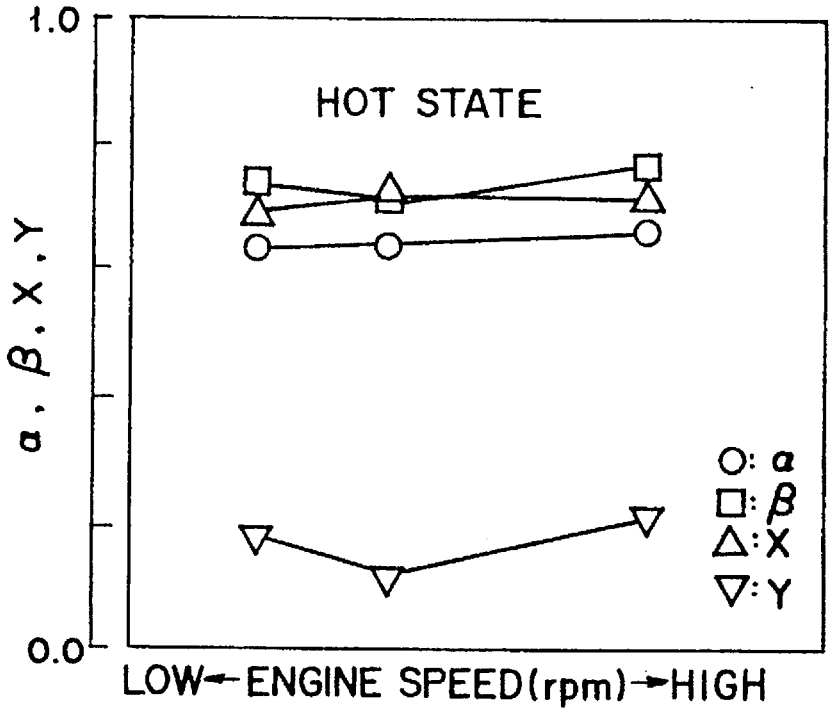

FIGS. 14 and 15 depict results of a comparison of effects by the internal pressure of the intake pipe, the coolant temperature and the engine speed with respect to the individual coefficients obtained from test results. Incidentally, FIG. 14 shows the characteristics at the time of predetermined engine revolution while FIG. 15 illustrates characteristics at the time of a warm state.

According to the results of the experiments, influence of the coolant temperature to these coefficients is observed, but it is understood that the coefficients are not affected substantially by the internal pressure of the intake pipe or the engine speed. Observing the influence of the coolant temperature to the individual coefficients, there is observed the tendency that the first-order delay coefficient Y clearly changes under the influence of the intake pipe wall temperature closest to the coolant temperature and α and X are also affected somewhat.

On the other hand, what is affected least by the coolant temperature is the distribution coefficient β of the two first-order delay elements, because β is the proportion of the quantity adhered on the intake valve out of the injected fuel and is considered to be a coefficient which relies upon the distribution of injected fuel.

With the foregoing in view, averages of the four coefficients α,β,X,Y are determined for individual coolant temperatures and are set on a characteristic map.

Figure 16:
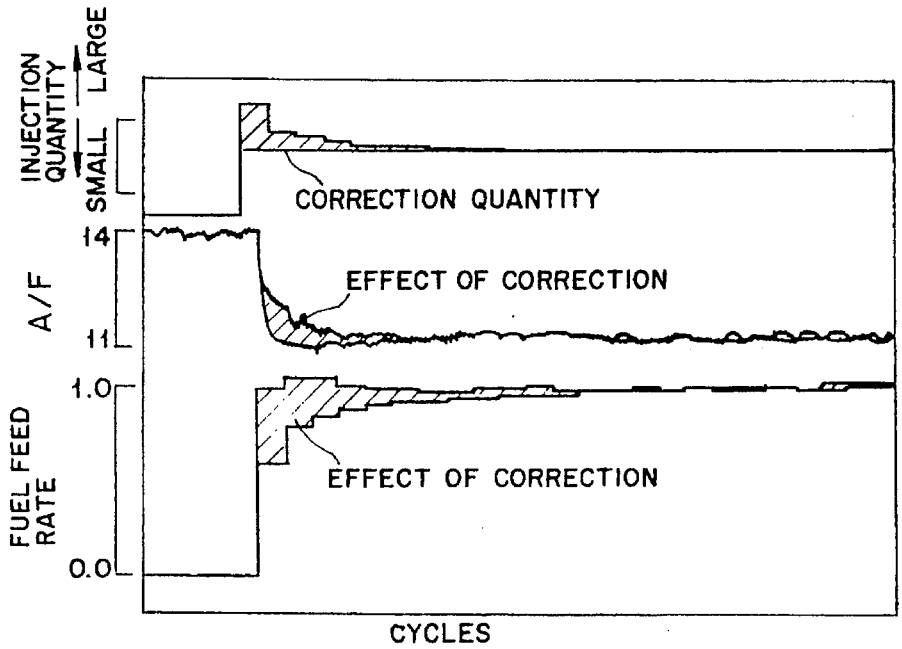

FIG. 16 illustrates one example of the result of compensation for a delay in the feeding of fuel when the target air/fuel ratio is changed stepwise while maintaining a predetermined engine speed and a predetermined engine load (a constant throttle opening) at the time of a cold engine state in the simplified model test described above.

As is shown in the drawing, it is observed that the feed rate promptly converges to 1.0 for each change in the target value of air/fuel ratio and fuel can hence be fed into the cylinder as intended.

Although the injection quantity is computed stroke by stroke, it is observed as if the value of the injection quantity is renewed for every 4 strokes as illustrated in the diagram. This is attributed to the computation and correction of the feed quantity for each cylinder. As a consequence, it is indicated to be sufficient under the present theorem of control if measurement and detection are conducted paying attention to one cylinder.

Figure 17:
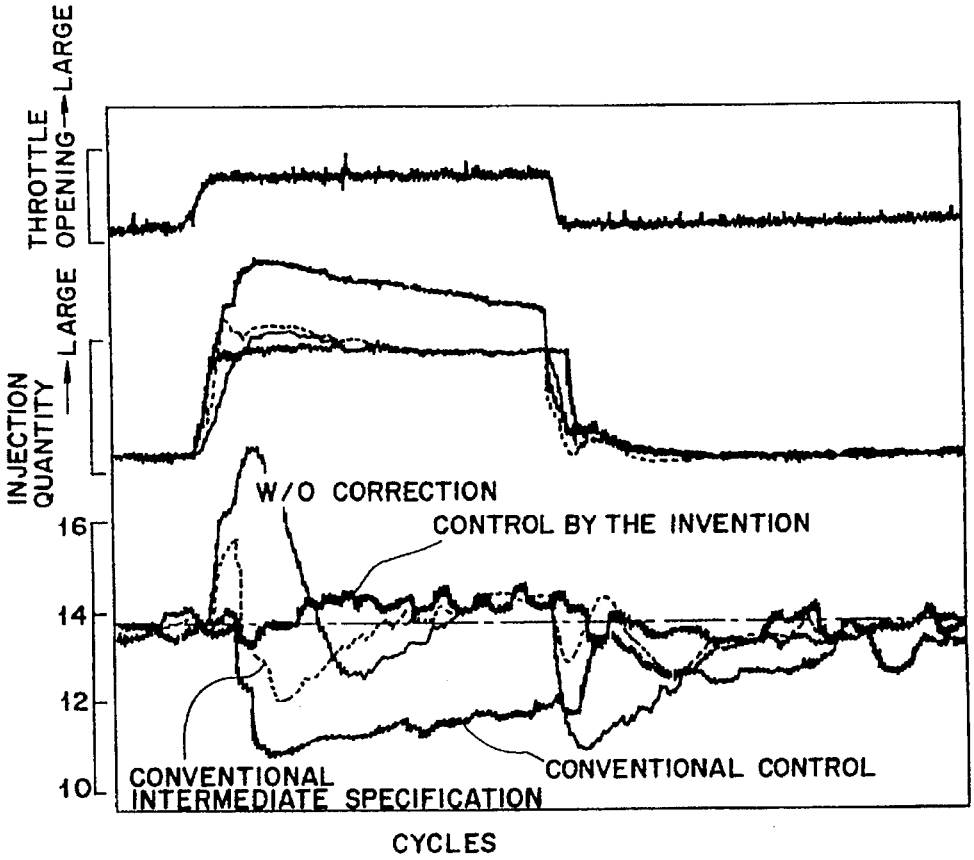
FIG. 17 is a diagram showing characteristics of results of control by the control system according to the one embodiment of the present invention for the engine.

FIG. 17 shows the results of actual deceleration/acceleration tests at predetermined engine speeds when the engine was in a cold state. Regarding fluctuations in air/fuel ratio, when no correction is effected, a significantly lean air/fuel ratio occurs in an initial stage of an acceleration and after that, the air/fuel ratio also remains very unstable. According to a conventional transitional correction, matching in air/fuel ratio is conducted to minimize lean misfires in an initial stage of acceleration so that a change to a richer air/fuel is unavoidable after the acceleration. When the gain is modified to an intermediate specification, a lean air/fuel ratio still occurs in an initial stage of acceleration and after that, the air/fuel ratio also remains unstable. Under the current situation that no optimal control constant can be obtained as mentioned above, the characteristics which have been achieved by this embodiment and are shown in the diagram make it possible to considerably stabilize the air/fuel ratio during both an acceleration and a deceleration.

The fuel injection control system of this embodiment for the engine has been constructed based on such significance as mentioned above. Upon control of fuel injection (control of the air/fuel ratio) by the present system, computation is conducted following the flow charts of FIGS. 4 and 5.

Figure 4:
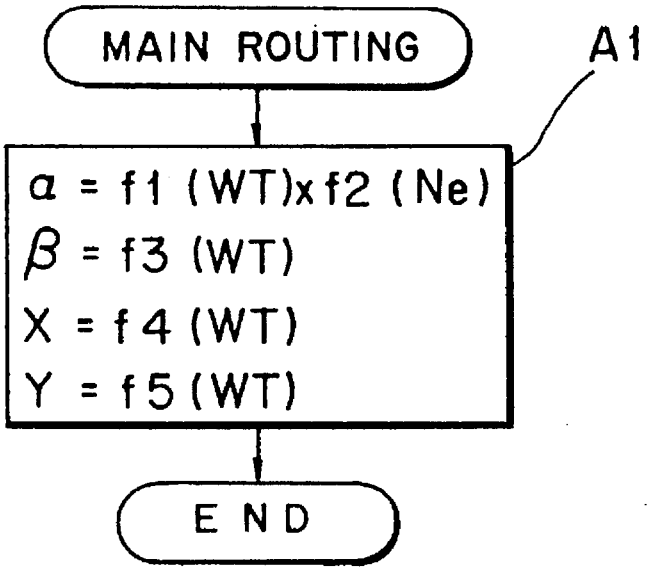
FIGS. 4 and 5 are flow charts describing respective control procedures by the control system according to the one embodiment of the present invention for the engine.
Figure 5:
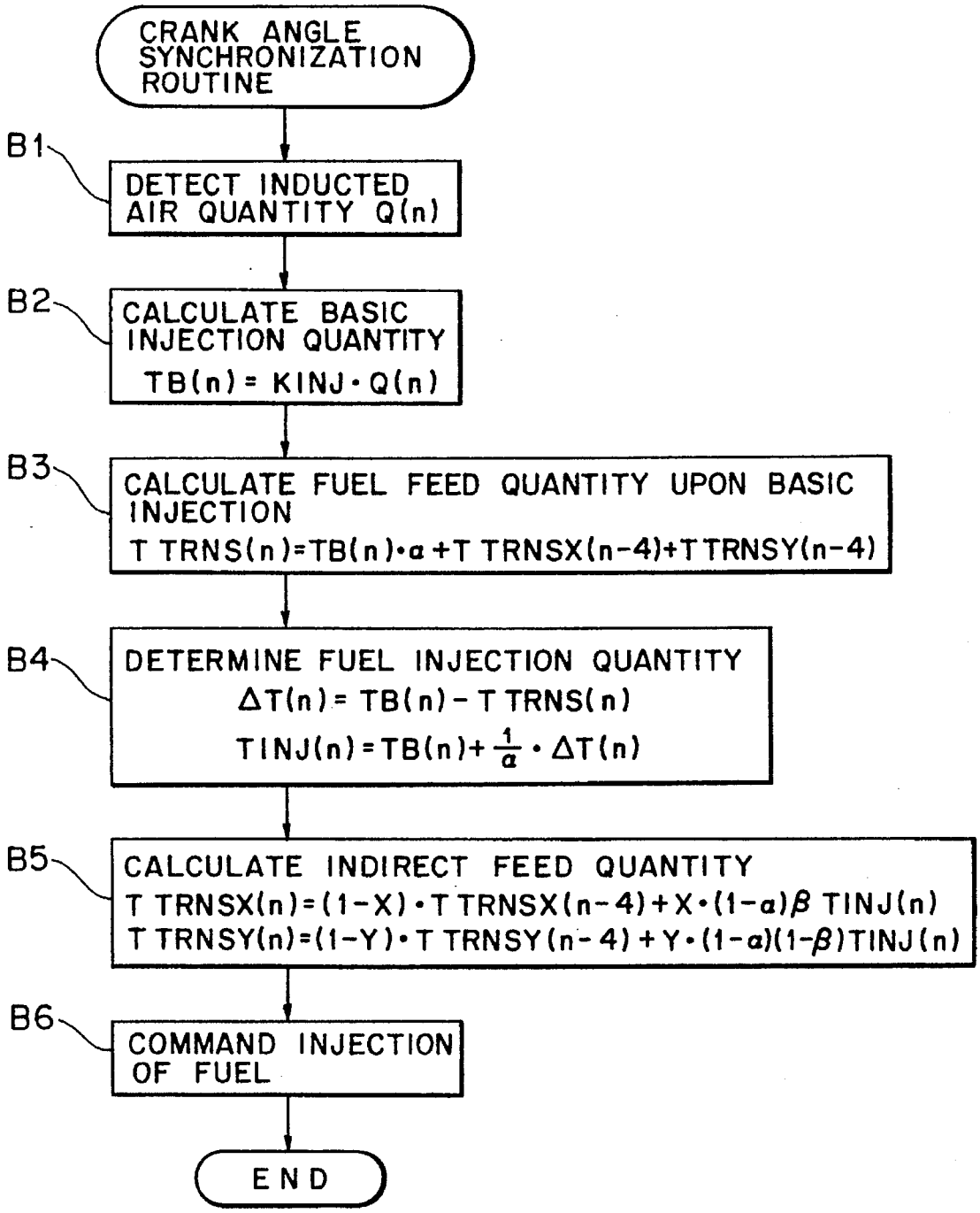

First, a main routine such as that shown in FIG. 4 is repeated at a predetermined computing cycle. In step A1 of this main routine, the individual coefficients α, β, X and Y are determined and read from the characteristics illustrated in the maps of FIG. 6 to FIG. 10.

Figure 6:
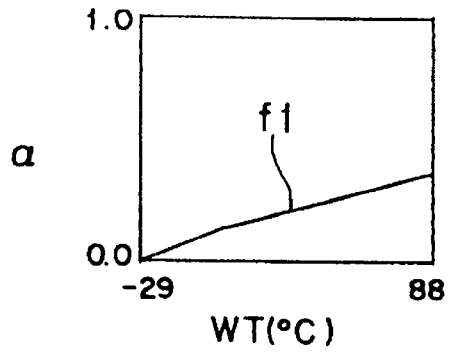
FIGS. 6 through 10 diagrammatically illustrate respective control characteristics of the control system according to the one embodiment of the present invention for the engine.

Described specifically, the direct feed rate α (=1−XX), which is the rate of fuel to be fed directly into the cylinder without adhesion in the intake port, is set in accordance with the map which is indicative of the characteristics f1 of FIG. 6. Upon this setting, the coolant temperature WT is referred to based on an output signal from the coolant temperature sensor 19 so that a characteristic value corresponding to the coolant temperature WT is determined.

Further, the direct feed rate α is corrected by a value in the map indicative of the characteristics f2 of FIG. 8. A correction value f2 (WT) corresponding to an engine speed Ne detected by the crank angle sensor 21 is read from the map, and the direct feed rate α is calculated by the following computation:

$$\alpha = f1(WT) \times f2(WT) \tag{4}$$

Next, as the distribution coefficient β, a value corresponding to the coolant temperature WT is set in accordance with the map indicative of the characteristics f3 of FIG. 7.

$$\beta = f3(WT) \tag{8}$$

Further, the smoothing coefficient X is set corresponding to the coolant temperature WT in accordance with the map indicative of the characteristics f4 of FIG. 9.

$$X = f4(WT) \tag{6}$$

Moreover, the smoothing coefficient Y is set corresponding to the coolant temperature WT in accordance with the map indicative of the characteristics f5 of FIG. 10.

$$Y = f5(WT) \tag{7}$$

The individual coefficients are set as described above and, responsive to prescribed calling commands from other routines, their values set at the time of the commands are outputted.

On the other hand, the crank angle synchronization routine which is performed in synchronization with the crank angle is also performed at a predetermined cycle.

First, the inducted air quantity Q(n) to the engine is calculated in step B1 on the basis of a detected signal from the air flow sensor 11.

Next, computation by the basic injection quantity setting means 101 is performed in step B2, so that the basic injection quantity TB(n) required to achieve a desired air/fuel ratio A/F relative to the inducted air quantity Q(n) to the engine is calculated in accordance with the following formula:

$$TB(n) = KINJ \cdot Q(n) \tag{3}$$

where KINJ is a fuel quantity conversion factor for converting an inducted air quantity to a fuel quantity and is given as a constant.

In step B3, the fuel feed quantity TTRNS(n) to the cylinder upon injection of the basic injection quantity TB(n) is then calculated in accordance with the following formula (9):

$$TTRNS(n) = TB(n) \cdot \alpha + TTRNSX(n-4) + TTRNSY(n-4) \tag{9}$$

In the above formula (9), TTRNSX(n−4) and TTRNSY(n−4) represent the first-part feed quantity and the second-part feed quantity, respectively, which will be calculated in step B5 to be described subsequently herein. Namely, the quantity of fuel evaporating from the fuel adhered on the valve and to be fed to the cylinder and the quantity of fuel evaporating from the intake pipe wall and to be fed to the cylinder are calculated by subjecting to smoothing processing the quantity of fuel injected in the preceding injection. The values calculated 1 cycle before are adopted.

In step B4, the fuel feed quantity ΔT(n) to be fed for the purpose of correction is next calculated in accordance with the following formula (10):

$$\Delta T(n)=TB(n)-TTRNS(n) \quad (10)$$

Using the direct feed rate α, the actual fuel injection quantity TINJ(n) reflecting the correction fuel feed quantity ΔT(n) is then calculated by the following formula:

$$TINJ(n)=TB(n)+(1/\alpha)\cdot\Delta T(n) \quad (12)$$

As a result, the actual injection quantity TINJ(n) for the cycle has been determined.

Step B5 is then performed to calculate TTRNSX and TTRNSY in accordance with the following formula:

$$TTRNSX(n)=(1-X)\cdot TTRNSX(n-4)+X\cdot(1-\alpha)\cdot\beta\cdot TINJ(n) \quad (13)$$

$$TTRNSY(n)=(1-Y)\cdot TTRNSY(n-4)+Y\cdot(1-\alpha)\cdot(1-\beta)\cdot TINJ(n) \quad (14)$$

The TTRNSX(n) and TTRNSY(n) calculated here will be used as TTRNSX(n–4) and TTRNSY(n–4) in the formula (9) upon computation for the next injection.

The computing processing described above is performed and from CPU 27, fuel injection control signals are outputted to the respective injector solenoids 8*a* via the associated injector solenoid drivers 34. The four injectors 8 are hence driven successively, whereby air/fuel ratio control is performed as desired.

According to the present embodiment, the following advantages can therefore be obtained:

(1) The temperature distribution which varies corresponding to the operation temperature of the engine, like the temperatures of the valve and the inner wall of the intake pipe, as well as the characteristics of evaporation and feeding of fuel from the inside of the intake port, said characteristics varying in response to variations in the temperature distribution, are precisely reflected in terms of a predetermined distribution ratio upon calculation of a fuel injection quantity, so that a correct fuel injection quantity commensurate with the state of operation can be calculated.

(2) The fuel—which subsequent to adhesion in the intake port, promptly evaporates and is fed—decreases at the time of a cold state (a low coolant temperature) so that the quantity of fuel to be fed directly out of the injected quantity of fuel is reduced. With respect to the control at this time, the direct feed rate is set depending on the engine temperature so that the fuel injection quantity is calculated corresponding to the reduction in the direct feed quantity, thereby making it possible to calculate an accurate fuel injection quantity commensurate with the state of operation.

(3) Owing to the above advantages (1) and (2), calculation of a precise fuel injection quantity is performed even during a transition period such as an acceleration or deceleration at the time of a cold state (i.e., a low coolant temperature). This always makes it possible to perform precise control on the air/fuel ratio and hence to achieve a stable operation state of the engine.

In the embodiment described above, the first-part feed quantity and the second-part feed quantity were represented by TTRNSX(n–4) and TTRNSY(n–4), respectively, because the first-part and second-part feed quantities for the same cylinder in the immediately preceding cycle were those for the (n–4)th cycle. In general, however, the first-part feed quantity for the same cylinder in the immediately preceding cycle can be expressed as "TTRNSX(n')" whereas the second-part feed quantity for the same cylinder in the immediately preceding cycle can be expressed as "TTRNSY(n')".

What is claimed is:

1. A fuel injection control system for an internal combustion engine, said system being provided with:

means for setting a basic injection quantity of fuel in correspondence to the quantity of air to be inducted and fed to said internal combustion engine so that a desired air/fuel ratio can be achieved in a combustion chamber, means for correcting the basic injection quantity, and means for injecting an actual injection quantity of fuel into an intake port of said internal combustion engine, said actual injection quantity having been obtained by correcting the basic injection quantity by said injection quantity correction means, wherein said injection quantity correction means comprises:

means for setting a direct feed rate at which a quantity of fuel out of the basic injection quantity is directly fed to said combustion chamber; and means for calculating an indirect feed quantity of fuel, said fuel being to evaporate from an adhered liquid layer of fuel in said intake port and then to be fed into said combustion chamber, as the sum of plural partial feed quantities of different evaporation characteristics.

2. A fuel injection control system according to claim 1, wherein said injection quantity correction means comprises:

means for calculating a direct feed quantity of fuel, said fuel being to be directly fed to said combustion chamber, based upon the basic injection quantity and the direct feed rate;

means for calculating a predicted feed quantity of fuel, which is predicted to be achieved by injecting the basic injection quantity of fuel, based upon the indirect feed quantity and the basic feed quantity;

means for calculating a correction quantity, which is needed to achieve feeding of fuel in the basic injection quantity, based upon the difference between the basic injection quantity and the predicted feed quantity and upon the direct feed rate; and means for calculating the actual injection quantity, in which fuel should be injected from said fuel injection means into said intake port, based upon the basic injection quantity and the correction quantity.

3. A fuel injection control system according to claim 2, wherein the direct feed rate is set as a function of the temperature and speed of said internal combustion engine.

4. A fuel injection control system according to claim 2, wherein said indirect feed quantity calculation means calculates the indirect feed quantity, and determines the indirect feed quantity repeatedly and calculates a present indirect feed quantity by using an actual injection quantity in which fuel has been injected immediately before the present injection, the direct feed rate, and an indirect feed quantity for the injection immediately before the present injection, said indirect feed quantity having been used for the calculation of the actual injection quantity in which fuel has been injected immediately before the present injection.

5. A fuel injection control system according to claim 4, wherein said indirect feed quantity calculation means calculates the indirect feed quantity by using means for calculating a first-part feed quantity occurring as a result of evaporation of fuel adhered on an intake valve and means for calculating a second-part feed quantity occurring as a result of evaporation of fuel adhered on a wall of said intake port.

6. A fuel injection control system according to claim 5, wherein a distribution coefficient at which the fuel injected into said intake port adheres on said intake valve and said wall of said intake port, respectively, is set based on areas of adhesion of said intake valve and said wall of said intake port, respectively; and in said indirect feed quantity calculation means, said first-part feed quantity calculation means calculates a present first-part feed quantity, which occurs as a result of evaporation of fuel adhered on said intake valve, by using an actual injection quantity in which fuel has been injected immediately before the present injection, the direct feed rate, the first-part feed quantity used for the calculation of the actual injection quantity in which fuel has been injected immediately before the present injection, and the distribution coefficient, and said second-part feed quantity calculation means calculates a present second-part feed quantity, which occurs as a result of evaporation of fuel adhered on said wall of said intake port, by using the actual injection quantity in which fuel has been injected immediately before the present injection, the direct feed rate, the second-part feed quantity used for the calculation of the actual injection quantity in which fuel has been injected immediately before the present injection and the distribution coefficient.

7. A fuel injection control system according to claim 6, wherein said distribution coefficient is set as a function of the ratio of the area of adhesion of said intake valve to that of said wall of said intake port and the temperature of said internal combustion engine.

8. A fuel injection control system according to claim 6, wherein said first-part feed quantity calculation means calculates the first-part feed quantity by using a first smoothing factor and said second-part feed quantity calculation means calculates the second-part feed quantity by using a second smoothing factor.

9. A fuel injection control system according to claim 8, wherein said first smoothing factor and said second smoothing factor are each set as a function of the temperature of said internal combustion engine, and the value of said first smoothing factor is set as a value greater than the value of the second smoothing factor.

10. A fuel injection control system according to claim 5, wherein said indirect feed quantity calculation means calculates the present first-part feed quantity and the present second-part feed quantity in accordance with the following formulas, respectively:

$$TTRNSX(n)=(1-X)\cdot TTRNSX(n')+X\cdot(1-\alpha)\cdot\beta\cdot TINJ(n)$$

$$TTRNSY(n)=(1-Y)\cdot TTRNSY(n')+Y\cdot(1-\alpha)\cdot(1-\beta)\cdot TINJ(n)$$

where

TTRNSX(n): the present first-part feed quantity,

TTRNSY(n): the present second-part feed quantity,

TINJ(n): the actual injection quantity in which fuel has been injected immediately before the present injection, TTRNSX(n'): the first-part feed quantity in the same cylinder immediately before the present injection, TTRNSY(n'): the second-part feed quantity in the same cylinder immediately before the present injection, X: the first smoothing factor, Y: the second smoothing factor, α: the direct feed rate, and β: the distribution coefficient.

11. A fuel injection control system according to claim 2, wherein said predicted feed quantity calculation means calculates the predicted feed quantity in accordance with the following formula:

$$TTRNS(n)=TB(n)\cdot\alpha+TTRNSX(n')+TTRNSY(n')$$

where

TTRNS (n): the predicted feed quantity,

TB(n): the basic injection quantity,

TTRNSX(n'): the first-part feed quantity in the same cylinder immediately before the present injection, TTRNSY(n'): the second-part feed quantity in the same cylinder immediately before the present injection, and α: the direct feed rate.

12. A fuel injection control system according to claim 2, wherein said correction quantity calculating means calculates the difference between the basic injection quantity and the predicted feed quantity, and compensates the calculated difference using the direct feed rate.

13. A fuel injection control method for injecting, into an intake port of an internal combustion engine, fuel in an actual injection quantity obtained by correcting a basic injection quantity of fuel set in correspondence to the quantity of air to be inducted and fed to said internal combustion engine so that a desired air/fuel ratio can be achieved in a combustion chamber, said method comprising the following steps:

(a) setting a direct feed rate at which a quantity of fuel out of the basic injection quantity is directly fed to said combustion chamber;

(b) calculating an indirect feed quantity of fuel, said fuel being to evaporate from an adhered liquid layer of fuel in said intake port and then to be fed into said combustion chamber;

(c) calculating a direct feed quantity of fuel, said fuel being to be directly fed to said combustion chamber, by using the basic injection quantity and the direct feed rate;

(d) calculating a predicted feed quantity of fuel, which is predicted to be achieved by injecting the basic injection quantity of fuel, by using the indirect feed quantity and the direct feed quantity;

(e) calculating a correction quantity, which is needed to achieve feeding of fuel in the basic injection quantity, based upon the difference between the basic injection quantity and the predicted feed quantity and upon the direct feed rate;

(f) calculating the actual injection quantity from the basic injection quantity and the correction quantity; and (g) injecting fuel in the actual injection quantity into the intake port of the internal combustion engine.

14. A fuel injection control method according to claim 13, wherein said indirect feed quantity calculation step (b) comprises the following sub-steps:

(b-1) determining the indirect feed quantity repeatedly; and (b-2) calculating a present indirect feed quantity by using an actual injection quantity in which fuel has been injected immediately before the present injection, the direct feed rate, and an indirect feed quantity for the injection immediately before the present injection, said indirect feed quantity having been used for the calculation of the actual injection quantity in which fuel has been injected immediately before the present injection.

15. A fuel injection control method according to claim 13, wherein said indirect feed quantity calculation step (b) calculates the indirect feed quantity of fuel as a sum of plural partial feed quantities of different evaporation characteristics, and further wherein said step (b) comprises the following sub-steps:

(b-1) calculating a first-part feed quantity occurring as a result of evaporation of fuel adhered on an intake valve; and (b-2) calculating a second-part feed quantity occurring as a result of evaporation of fuel adhered on a wall of said intake port.

16. A fuel injection control method according to claim 13, wherein said indirect feed quantity calculation step (b) calculates the indirect feed quantity of fuel as a sum of plural partial feed quantities of different evaporation characteristics, and further wherein said step (b) comprises the following sub-steps:

(b-1) setting a distribution coefficient, at which the fuel injected into said intake port adheres on said intake valve and said wall of said intake port, respectively, based on areas of adhesion of said intake valve and said wall of said intake port, respectively, and setting a first smoothing coefficient and second smoothing coefficient which correspond to rates of evaporation of the adhered fuel from said intake valve and said wall of said intake port, respectively; and (b-2) calculating a present first-part feed quantity, which occurs as a result of evaporation of the fuel adhered on said intake valve, by using an actual injection quantity in which fuel has been injected immediately before the present injection, the direct feed rate, the first-part feed quantity used for the calculation of the actual injection quantity in which fuel has been injected immediately before the present injection, the distribution coefficient, and the first smoothing coefficient, and calculating a present second-part feed quantity, which occurs as a result of evaporation of the fuel adhered on said wall of said intake port, by using the actual injection quantity in which fuel has been injected immediately before the present injection, the direct feed rate, the second-part feed quantity used for the calculation of the actual injection quantity in which fuel has been injected immediately before the present injection, the distribution coefficient, and the second smoothing coefficient.

17. A fuel injection control method according to claim 16, wherein said distribution coefficient is set as a function of the ratio of the area of adhesion of said intake valve to that of said wall of said intake port and the temperature of said internal combustion engine.

18. A fuel injection control method according to claim 16, wherein said first smoothing factor and said second smoothing factor are each set as a function of the temperature of said internal combustion engine, and the value of said first smoothing factor is set as a value greater than the value of the second smoothing factor.

19. A fuel injection control method according to claim 13, wherein said step (e) includes the following sub-steps:

(e-1) calculating the difference between the basic injection quantity and the predicted feed quantity, and (e-2) compensating the difference calculated in said step (e-1) using the direct feed rate.

20. A method for controlling fuel injection comprising the steps of:

(a) setting a basic injection quantity of fuel in correspondence to a quantity of air to be inducted and fed to an engine so that a desired air/fuel ratio can be achieved in a combustion chamber of the engine;

(b) correcting the basic injection quantity, and (c) injecting an actual injection quantity of fuel into an intake port of the engine, the actual injection quantity having been obtained by correcting the basic injection quantity in said step (b);

wherein said step (b) includes the following sub-steps:

setting a direct feed rate at which a quantity of fuel out of the basic injection quantity is directly fed to the combustion chamber; and calculating an indirect feed quantity of fuel, the fuel being to evaporate from an adhered liquid layer of fuel in the intake port and then to be fed into the combustion chamber, as the sum of plural partial feed quantities of different evaporation characteristics.

21. The method of claim 20, wherein said step (b) further includes the sub-steps of:

calculating a direct feed quantity of fuel, said fuel being to be directly fed to the combustion chamber, based upon the basic injection quantity and the direct feed rate;

calculating a predicted feed quantity of fuel, which is predicted to be achieved by injecting the basic injection quantity of fuel, based upon the indirect feed quantity and the basic feed quantity;

calculating a correction quantity, which is needed to achieve feeding of fuel in the basic injection quantity, based upon the difference between the basic injection quantity and the predicted feed quantity and upon the direct feed rate; and calculating the actual injection quantity, in which fuel should be injected into the intake port, based upon the basic injection quantity and the correction quantity.

22. The method of claim 21, where in the direct feed rate is set as a function of the temperature and speed of the engine.

23. The method of claim 21, wherein said substep of calculating the indirect feed quantity calculates the indirect feed quantity, and determines the indirect feed quantity repeatedly and calculates a present indirect feed quantity by using an actual injection quantity in which fuel has been injected immediately before the present injection, the direct feed rate, and an indirect feed quantity for the injection immediately before the present injection, the indirect feed quantity having been used for the calculation of the actual injection quantity in which fuel has been injected immediately before the present injection.

24. The method of claim 23, wherein said substep of calculating the indirect feed quantity calculates the indirect feed quantity by calculating a first-part feed quantity occurring as a result of evaporation of fuel adhered on an intake valve and calculating a second-part feed quantity occurring as a result of evaporation of fuel adhere on a wall of the intake port.

25. The method of claim 24, wherein a distribution coefficient at which the fuel injected into the intake port adheres on the intake valve and the wall of the intake port, respectively, is set based on areas of adhesion of the intake valve and the wall of the intake port, respectively; and said step of calculating the first-part feed quantity calculates a present first-part feed quantity, which occurs as a result of evaporation of fuel adhered on the intake valve, by using an actual injection quantity in which fuel has been injected immediately before the present injection, the direct feed rate, the first-part feed quantity used for the calculation of the actual injection quantity in which fuel has been injected immediately before the present injection, and the distribution coefficient, and said step of calculating the second-part feed quantity calculates a present second-part feed quantity, which occurs as a result of evaporation of fuel adhered on the wall of the intake port, by using the actual injection quantity in which fuel has been injected immediately before the present injection, the direct feed rate, the second-part feed quantity used for the calculation of the actual injection quantity in which fuel has been injected immediately before the present injection, and the distribution coefficient.

26. The method of claim 25, wherein the distribution coefficient is set as a function of the ratio of the area of adhesion of the intake valve to that of the wall of the intake port and the temperature of the engine.

27. The method of claim 25, wherein said step of calculating the first-part feed quantity calculates the first-part feed quantity by using a first smoothing factor and said step of calculating the second-part feed quantity calculates the second-part feed quantity by using a second smoothing factor.

28. The method of claim 27, wherein the first smoothing factor and the second smoothing factor are each set as a function of the temperature of the engine, and the value of the first smoothing factor is set as a value greater than the value of the second smoothing factor.

29. The method of claim 24, wherein said substep of calculating the indirect feed quantity calculates the present first-part feed quantity and the present second-part feed quantity in accordance with the following formulas, respectively:

$$TTRNSX(n)=(1-X)\cdot TTRNSX(n')+X\cdot(1-\alpha)\cdot\beta\cdot TINJ(n)$$

$$TTRNSY(n)=(1-Y)\cdot TTRNSY(n')+Y\cdot(1-\alpha)\cdot(1-\beta)\cdot TINJ(n)$$

where

TTRNSX(n): the present first-part feed quantity,

TTRNSY(n): the present second-part feed quantity,

TINJ(n): the actual injection quantity in which fuel has been injected immediately before the present injection, TTRNSX(n'): the first-part feed quantity in the same cylinder immediately before the present injection, TTRNSY(n'): the second-part feed quantity in the same cylinder immediately before the present injection, X: the first smoothing factor, Y: the second smoothing factor, $\alpha$: the direct feed rate, and $\beta$: the distribution coefficient.

30. The method of claim 21, wherein said substep of calculating the predicted feed quantity calculates the predicted feed quantity in accordance with the following formula:

$$TTRNS(n)=TB(n)\cdot\alpha+TTRNSX(n')+TTRNSY(n')$$

where

TTRNS(n): the predicted feed quantity,

TB(n): the basic injection quantity,

TTRNSX(n'): the first-part feed quantity in the same cylinder immediately before the present injection, TTRNSY(n'): the second-part feed quantity in the same cylinder immediately before the present injection, and $\alpha$: the direct feed rate.

31. The method of claim 21, wherein said substep of calculating the correction quantity calculates the difference between the basic injection quantity and the predicted feed quantity, and compensates the calculated difference using the direct feed rate.

* * * * *